US005118104A

United States Patent [19]

DeLanzo

[11] Patent Number: 5,118,104

[45] Date of Patent: Jun. 2, 1992

[54] BATTING AID

[76] Inventor: Tony DeLanzo, 102 Triton Cir., Encinitas, Calif. 92024

[21] Appl. No.: 726,970

[22] Filed: Jul. 8, 1991

[51] Int. Cl.[5] ..... A63B 69/40

[52] U.S. Cl. ..... 273/26 C; 273/190 B; 273/188 R; 273/29 A; 273/DIG. 17

[58] Field of Search ..... 273/26 C, 26 R, 29 A, 273/183 B, 183 E, 188 R, 190 R, 190 B, 190 C, DIG. 17, DIG. 19, 186 C

[56] References Cited

U.S. PATENT DOCUMENTS

| | | | |
|---|---|---|---|
| 2,528,077 | 10/1950 | Pond | 273/190 B |
| 3,059,932 | 10/1962 | Smallwood | 273/190 B |
| 4,300,765 | 11/1981 | Stringham | 273/26 C |
| 4,527,982 | 7/1985 | Salzman | 273/29 A |
| 4,605,226 | 8/1986 | Morrissey | 273/26 C |
| 4,746,118 | 5/1988 | Deveney | 273/26 C |
| 4,826,165 | 5/1989 | Socci | 273/26 R |
| 4,875,677 | 10/1989 | Tetreault | 273/26 C |

*Primary Examiner*—Theatrice Brown
*Attorney, Agent, or Firm*—Calif Kip Tervo

[57] ABSTRACT

A batting training aid for biasing the batter's head at a position of rotation relative to the batter's back hip such that the batter's eyes are in the best position during ball contact for achieving ball contact generally comprises an elastic strap having a top end that attaches to the batter's helmet on the side toward the pitcher and having a bottom end that attaches to the batter's waist at the back hip. A chin strap for passing over the batter's chin has a front end connected to the strap top end and back end for attaching to the helmet back side.

12 Claims, 1 Drawing Sheet

BATTING AID

BACKGROUND OF THE INVENTION

1. Field of the Invention

The invention relates in general to a batting aid to assist the batter in maintaining proper eye contact with a pitched ball and more particularly to a device that biases the batter's head to a desired angle of rotation relative to the batter's back hip.

2. Description of the Related Art

It is well recognized in the game of baseball that the batter should watch the ball from the moment it leaves the pitcher's hand to the contact zone where the bat meets the ball. A very natural tendency is for the batter to turn his head toward the pitcher during the swing so as to not be facing the contact zone at the proper time. The result is that the ball is often not struck or is struck poorly.

Various prior art devices have attempted to remedy this situation. U.S. Pat. No. 4,300,765 of Stringham describes a batting aid for maintaining eye-to-ball contact during a swing. the device comprises a shoulder piece for fitting against the forward shoulder and a jaw piece for fitting against the batter's jaw. The jaw piece is resiliently connected to the shoulder piece to impede motion of the jaw piece, and consequently of the batter's head, towards the shoulder piece during a swing. U.S. Pat. No. 4,826,165 of Socci discloses another prior art training device for hitting a baseball The device comprises a shoulder harness with a chin holder connected thereto in a manner that allows for movement of the batter's chin in an elliptical manner from the front shoulder to the back shoulder during the course of the swing. U.S. Pat. No. 4,746,118 of Delvaney discloses a batting aid including a flexible strap connecting the batter's back shoulder with the back side of the batter's helmet to hold the head in fixed relationship to the back shoulder.

I have found that such devices which connect the head to the shoulders or upper torso do not hold the head in the best position for striking the ball. This is so because the head must rotate relative to the shoulders during the swing to attain the proper position ball striking position. The present invention provides a superior device for achieving the desired result.

SUMMARY OF THE INVENTION

This invention is a batting training aid for biasing the batter's head at a position of rotation relative to the batter's back hip such that the batter's eyes are in the best position during ball contact for achieving ball contact. The batting aid generally comprises an elastic strap having a top end that attaches to the batter's helmet on the side toward the pitcher and having a bottom end that attaches to the batter's waist at the back hip. A chin strap for passing over the batter's chin has a front end connected to the strap top end and back end for attaching to the helmet back side.

Other features and many attendant advantages of the invention will become more apparent upon a reading of the following detailed description together with the drawings in which like reference numerals refer to like parts throughout.

DETAILED DESCRIPTION OF THE INVENTION

Figure 1:
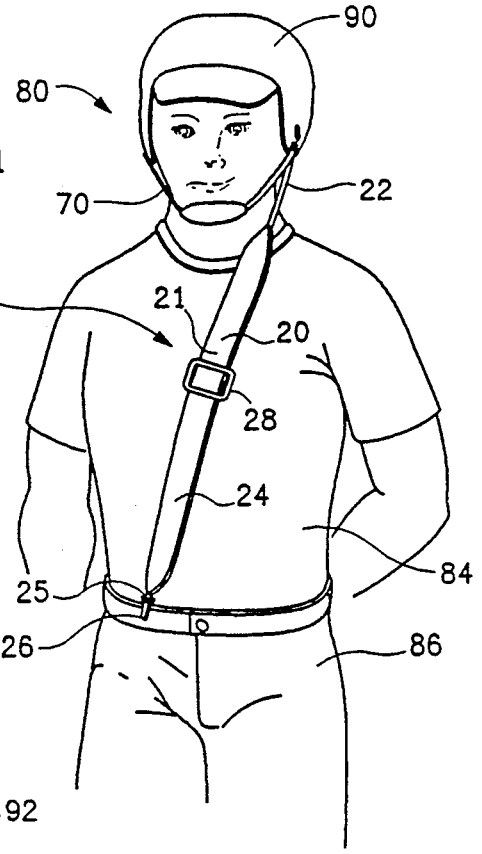
FIG. 1 is a view of a batter equipped with a preferred embodiment of the batting aid of the invention.

With reference now to the drawings, and more particularly to FIG. 1 thereof, there is shown a batter 80 equipped with a preferred embodiment of the batting aid, denoted generally as 10, of the present invention. Batter 80 is wearing a jersey 84 and pants 86. The preferred embodiment of the batting aid 10 generally comprises restraining strap means, including restraining strap 20, a chin strap 70, and batter's head gear, such as batter's helmet 90. One end of restraining strap 20 attaches to the helmet front side 92 , i.e. toward the pitcher, and the other end attaches to the batter's back hip with the strap middle section 21 passing across the batter's chest.

Figure 2:
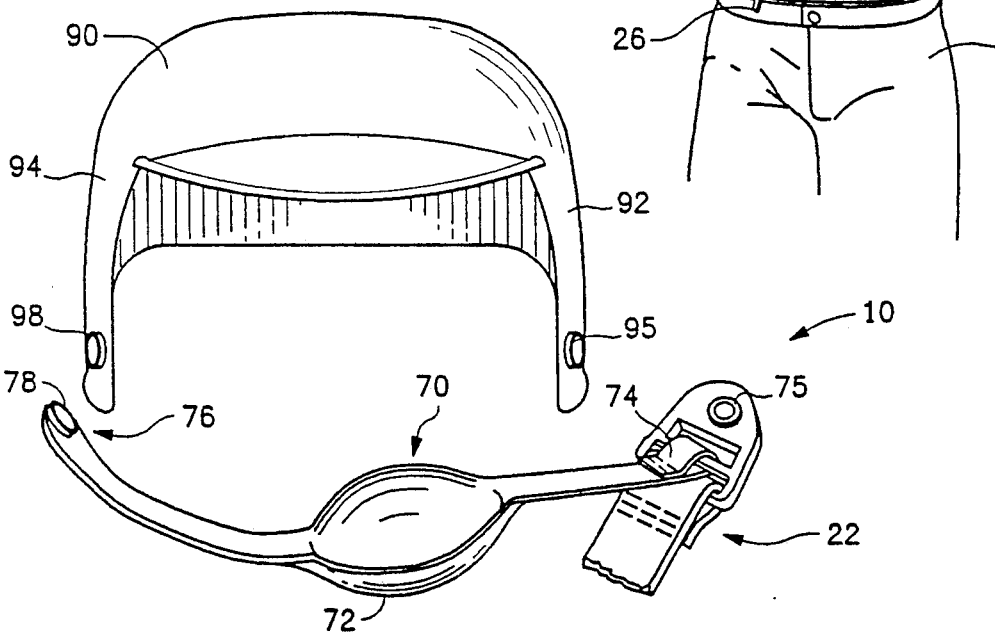
FIG. 2 is an enlarged perspective view of the preferred embodiment of the invention of FIG. 1.
Figure 2:
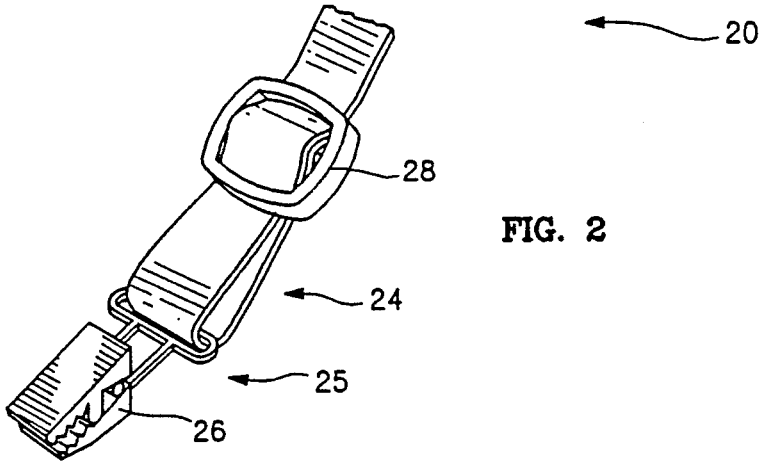

Looking also at FIG. 2, there is shown an enlarged view of the batting aid of the present invention. Restraining strap 20 is preferably elastic and made primarily of elastic material or includes an elastic section Strap 20 has a top end 22 and a bottom end 24. Strap top end 22 includes attachment means, such as a typical snap fitting 75, for attaching the strap top end 22 to helmet 90. Strap bottom end 24 includes attachment means, such as locking toothed clip 26, for attaching strap bottom end 24 to the batter such that restraining strap passes across the batter's chest to the batter's back hip 88, i.e. the hip away from the pitcher.

Locking toothed clip 26 is attached to the batter's waist, such as to pants 86. Locking toothed clip 26 is hinged clip comprising two levers hingedly connected about their midsection and constructed such that tension on the attached strap 20 biases the clip 26 in the closed position. This is a safety feature. Other attachment means, such as a belt hook or a spring biased clamp are contemplated. Alternately, the bottom end attachment means could be a loop for going around the batters upper leg.

In the embodiment shown, restraining strap 20 is adjustable in length so as to fit various size batters. Restraining strap passes through ring 25 and doubles back on itself to terminate at length adjustment buckle 28 which is a standard sliding friction buckle. Other adjustment means may be used, such as overlapping hook/loop fastener sections.

Chin strap 70 passes under a batter's chin to aid in retaining helmet 90 on the batter's head. A chin cup 72 fits over the batter's chin and minimizes movement of the helmet on the head. Chin strap 70 has a first end 74 attached to restraining strap top end 22 and a second end 76 including attachment means, such as snap fitting 78 for attachment to the helmet back side as shown.

The head gear, such as helmet 90, is intended to be worn by the batter and to be secured to the batter's head. The batter's head gear would typically be a batter's helmet 90, as shown, but it can be seen that other head gear such as a harness could also be used and such are contemplated in the appended claims. Helmet 90 has a front side 92 toward the pitcher and a back side 94 away from the pitcher. Helmet 90 typically includes portions covering the batter's ears. A pair of helmet snap fittings 95,98 are located on the lower end of the ear covers. Helmet front side snap fitting 95 mates with strap top end snap fitting 75 for attaching strap 20 to helmet 90. Helmet back side snap fitting 98 mates with chin strap snap fitting 78 for attaching chin strap 70 to the back side of helmet 90. Preferably, the helmet snap fittings are identical so that the same helmet can be used for both left and right handed batters.

The length of strap 20 is adjusted such that the forward rotation of the batter's head relative to the batter's back hip is restricted. In this manner, strap 20 biases the batter's head, and therefore the batter's eyes, such that it more nearly faces the point of ball contact at the moment of contact. The elasticity in the in the strap prevents shock to the head if the head is turned quickly and the strap suddenly becomes taut. The elastic strap acts as a firm but gentle reminder to keep the head in the proper position to assure ball contact. However, the batting aid still permits movement by the batter to avoid a badly thrown pitch.

Having described the invention, it can be seen that it provides a very effective batting training aid. During the swing of the bat, the arms both accelerate at different speeds, then the shoulders begin to rotate and the upper torso rotates. Finally the back hip rotates. By connecting the restraining strap to the back hip region of the batter, the head is restrained from forward rotation for a longer time and is held in the proper hitting position until the desired time.

Although a particular embodiment of the invention has been illustrated and described, various changes may be made in the form, composition, construction, and arrangement of the parts without sacrificing any of its advantages. Therefore, it is to be understood that all matter herein is to be interpreted and illustrative and not in any limiting sense and it is intended to cover in the appended claims such modifications as come within the true spirit and scope of the invention.

I claim:

1. A batting aid for a batter comprising in combination:

head gear worn by a batter; said head gear having a front side toward a pitcher when the batter is in a normal batting position and a rear side opposite said front side; and a restraining strap having:

a top end including attachment means attaching said strap top end to the front side of said head gear; and a bottom end including attachment means attaching said restraining strap bottom end to the batter such that said restraining strap passes across a batter's chest to a batter's back hip and bias the batter's head against forward rotation.

2. The batting aid of claim 1 wherein:

said restraining strap is elastic.

3. The batting aid of claim 1 wherein:

said restraining strap includes length adjustment means for adjusting the length of the strap for accommodating different size batters.

4. The batting aid of claim 1 wherein:

said head gear includes a snap fitting on its said front side; and said restraining strap top end attachment means includes a mating snap fitting.

5. The batting aid of claim 1 further including:

a chin strap passing under the batter's chin for retaining said head gear on the batter's head; said chin strap having:

a first end attached to said restraining strap top end; and a second end including attachment means attached to said head gear rear side.

6. The batting aid of claim 1 wherein:

said restraining strap bottom end attachment means includes a clip for attachment to a batter's clothes.

7. The batting aid of claim 1 wherein:

said restraining strap bottom end attachment means includes a clip for attachment to a batter's pants.

8. A batting aid for a batter comprising in combination:

a head gear worn by a batter; said head gear having a front side toward a pitcher when the batter is in a normal batting position and a rear side opposite said front side away from a pitcher; and a restraining strap having:

a top end including attachment means attaching said restraining strap top end to said front side of said head gear; and a bottom end including attachment means attaching said restraining strap bottom end to a batter such that said restraining strap passes across a batter's chest to a batter's back hip and biases the batter's head against forward rotation; and a chin strap for passing under a batter's chin for retaining said head gear on a batter's head; said chin strap having:

a first end attached to said restraining strap top end; and a second end including attachment means attached to said head gear rear side.

9. The batting aid of claim 8 wherein:

said head gear front side includes a snap fitting and said head gear rear side includes a snap fitting; and said restraining strap top end attachment means includes:

a mating snap fitting for said head gear front side snap fitting; and said chin strap second end attachment means includes a mating snap fitting for said head gear rear side snap fitting.

10. The batting aid of claim 8 wherein:

said restraining strap is elastic.

11. The batting aid of claim 8 wherein:

said restraining strap includes length adjustment means for adjusting the length of said restraining strap between said top end adjustment means and said bottom end adjustment means for accommodating different size batters.

12. A method of biasing a batter's head with his eyes toward a ball contact point comprising the steps of:

placing head gear on a batter;

attaching a first end of a strap to the head gear on the side toward a pitcher; and attaching a second end of the strap to a batter's hip such that the strap passes across the batter's chest to a batter's back hip such that the batter's head is restrained from forward rotation relative to his rear hip.

* * * * *